US007150376B2

(12) United States Patent
Tsai

(10) Patent No.: US 7,150,376 B2
(45) Date of Patent: Dec. 19, 2006

(54) DOUBLE-LAYERED FLUID CONTAINER

(76) Inventor: Chang-Keng Tsai, P.O. Box 82-144, Taipei (TW)

( * ) Notice: Subject to any disclaimer, the term of this patent is extended or adjusted under 35 U.S.C. 154(b) by 456 days.

(21) Appl. No.: 10/701,507

(22) Filed: Nov. 6, 2003

(65) Prior Publication Data

US 2005/0098568 A1 May 12, 2005

(51) Int. Cl.
*B65D 35/28* (2006.01)

(52) U.S. Cl. ..... 222/95; 222/105; 222/189.09; 222/209; 137/533.19

(58) Field of Classification Search ..... 222/386.5, 222/212, 105, 107, 92, 189.06, 206, 83.5, 222/213, 484, 494, 491; 137/513.7, 533.19
See application file for complete search history.

(56) References Cited

U.S. PATENT DOCUMENTS 2,677,465 A * 5/1954 Meyer ..... 210/482
2,677,495 A * 5/1954 Buttery ..... 229/117
3,064,860 A * 11/1962 Madaffer ..... 222/153.09
3,098,589 A * 7/1963 Graham ..... 222/402.22
3,098,598 A * 7/1963 Weisgerber et al. ..... 229/5.85
3,572,377 A * 3/1971 Graham et al. ..... 137/513.7
3,682,558 A * 8/1972 Miller ..... 401/200
3,814,292 A * 6/1974 Dargols ..... 222/190
4,035,303 A * 7/1977 Ufferfilge ..... 210/316
4,154,366 A * 5/1979 Acres ..... 222/212
5,282,549 A * 2/1994 Scholz et al. ..... 222/95
5,487,490 A * 1/1996 Estes ..... 222/1
5,665,070 A * 9/1997 McPhee ..... 604/131
6,062,430 A * 5/2000 Fuchs ..... 222/105
6,305,577 B1 * 10/2001 Fillmore et al. ..... 222/95

* cited by examiner

*Primary Examiner*—Kevin Shaver
*Assistant Examiner*—Stephanie E. Tyler
(74) *Attorney, Agent, or Firm*—Leong C. Lei

(57) ABSTRACT

A double-layered fluid container which includes an upper diaphragm and a lower diaphragm, which provides alternating squeezing action so that the upper diaphragm and the lower diaphragm causes an opening and a closing action to the container. The contents in the container are isolated from the external contact with air and therefore oxidation process is inhibited and the container provides a constant delivery of the contents and the contents are prevented from back flowing into the container. The delivery of the contents can be controlled at a stable squeezing pressure.

1 Claim, 4 Drawing Sheets

DOUBLE-LAYERED FLUID CONTAINER

BACKGROUND OF THE INVENTION (a) Technical Field of the Invention

The present invention relates to a container having an inner and outer layer together with an upper and lower diaphragm to provide a container with constant amount, isolation, anti-reverse flow delivery.

(b) Description of the Prior Art

Conventional tubular container such as container for toothpaste, cream, chemical agent, emulsifier, etc as shown in FIG. 1, comprises a cap A1 and a tubular container A2. With respect to material for the tubular container A2, there are either rubber material or thin aluminum metallic material. For the tubular container made from rubber material, a squeezing action to the container causes the contents in the container to be delivered. When the squeezing action is released, the rubber container will restore to its original shape.

The drawbacks of the conventional tubular containers are as follows:

(1) When the tubular container restores to its original shape, air will be sucked in and will oxidize the contents within the container. Such oxidation will affect the stability and quality of the contents.

(2) Due to the fact that the delivery of the contents is by a squeezing action and controlling by squeezing is rather difficult and therefore the contents that delivered are normally either too little or too much.

(3) When the contents in the tubular container are ended soon, there will be remaining within the container and it may not be easily delivered. Therefore, it is a waste of contents in the container.

As for aluminum material tubular container, the drawbacks are that:

(1) Due to the fact that the container does not restore to its original shape, the shape of the container, from the initial stage of use until the end stage, changes anytime. Therefore, the shape is rough and unpleasant.

(2) If the squeezing force is too excessive and the shape of the tubular container changes, the contents within the container will flow out continuously, and it is a waste of material/contents.

(3) There are residues in the tubular container when the contents are going to be used up soon.

In view of the above drawbacks, it is an object of the present invention to provide a double-layered fluid container, which mitigates the above drawbacks.

SUMMARY OF THE INVENTION

An aspect of the present invention is to provide a double-layered fluid container including an enclosure and a cap, characterized in that the enclosure including an inner and outer layer and the inner layer being an inner pocket with elasticity and the outer layer being an outer-layered container which can be restored after the container is depressed or squeezed, and an end opening of the inner-layered pocket being connected to form as a unit, the upper and lower end of the outer-layered container is divided into a top and bottom diaphragm slot so that the top and bottom diaphragm are respectively mounted to the slot thereof to form alternating switching operation, the upper diaphragm is a netted hole layer and the lower diaphragm is an outlet layer, and the lower diaphragm slot is a netted-hole slot, and the lower layer is an inlet layer such that the upper and lower diaphragm having an isolation slot is restorable within the slot.

An object of the present invention is to provide a double-layered fluid container, which can prohibit air from entering the container to oxidize the contents in the container.

Yet a further object of the present invention is to provide a double-layered fluid container, wherein the container will restore to its original shape after a squeezing action to the container.

Still a further object of the present invention is to provide a double-layered fluid container, wherein the contents in the container can be smoothly delivered by squeezing even when the contents are ended soon.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
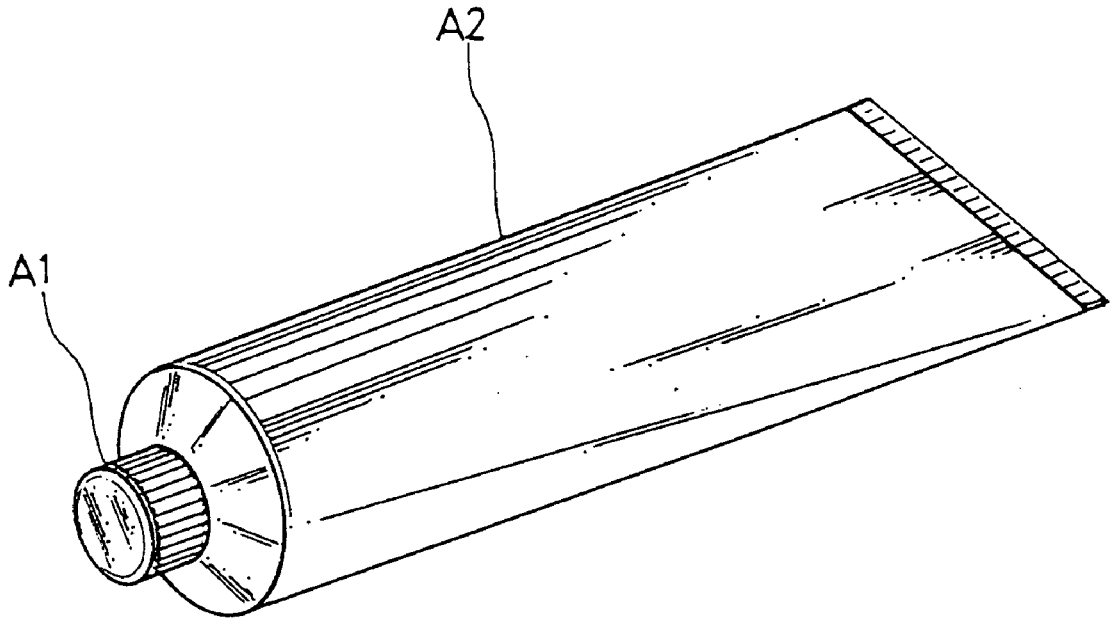
PRIOR ART FIG. 1
FIG. 1 is a perspective view of a conventional tubular container.
Figure 2:
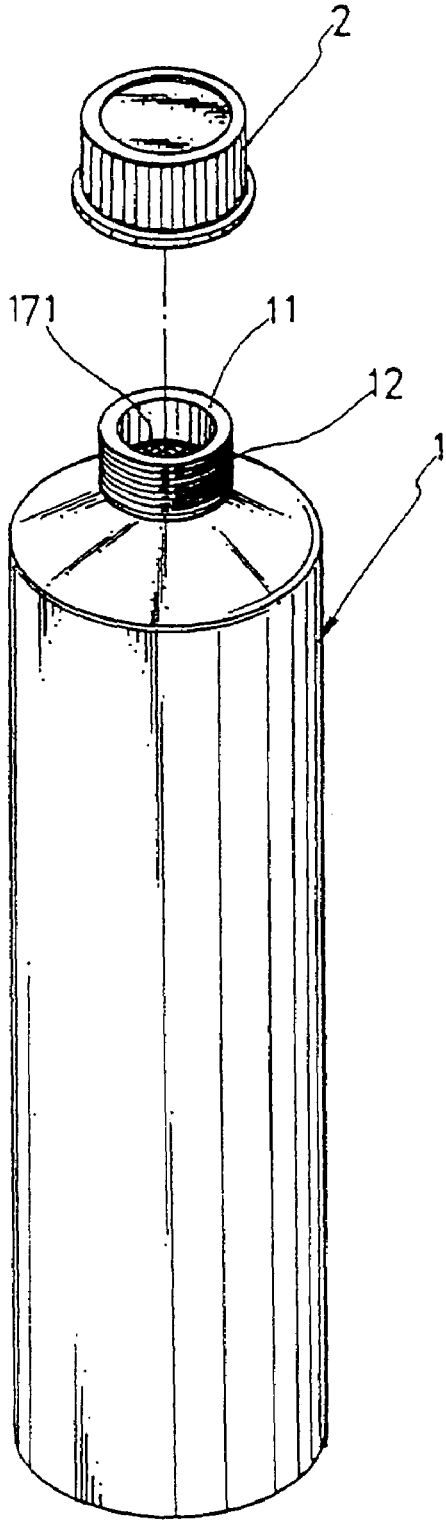
FIG. 2 is a perspective view of a preferred embodiment in accordance with the present invention.

Referring to FIG. 2, the tubular container of the present invention includes an enclosure 1 and a cap 2. The enclosure 1 has an end opening section 11 and the external edge of the end opening section 11 is provided with threads 12 for the locking with the cap 2.

Figure 3:
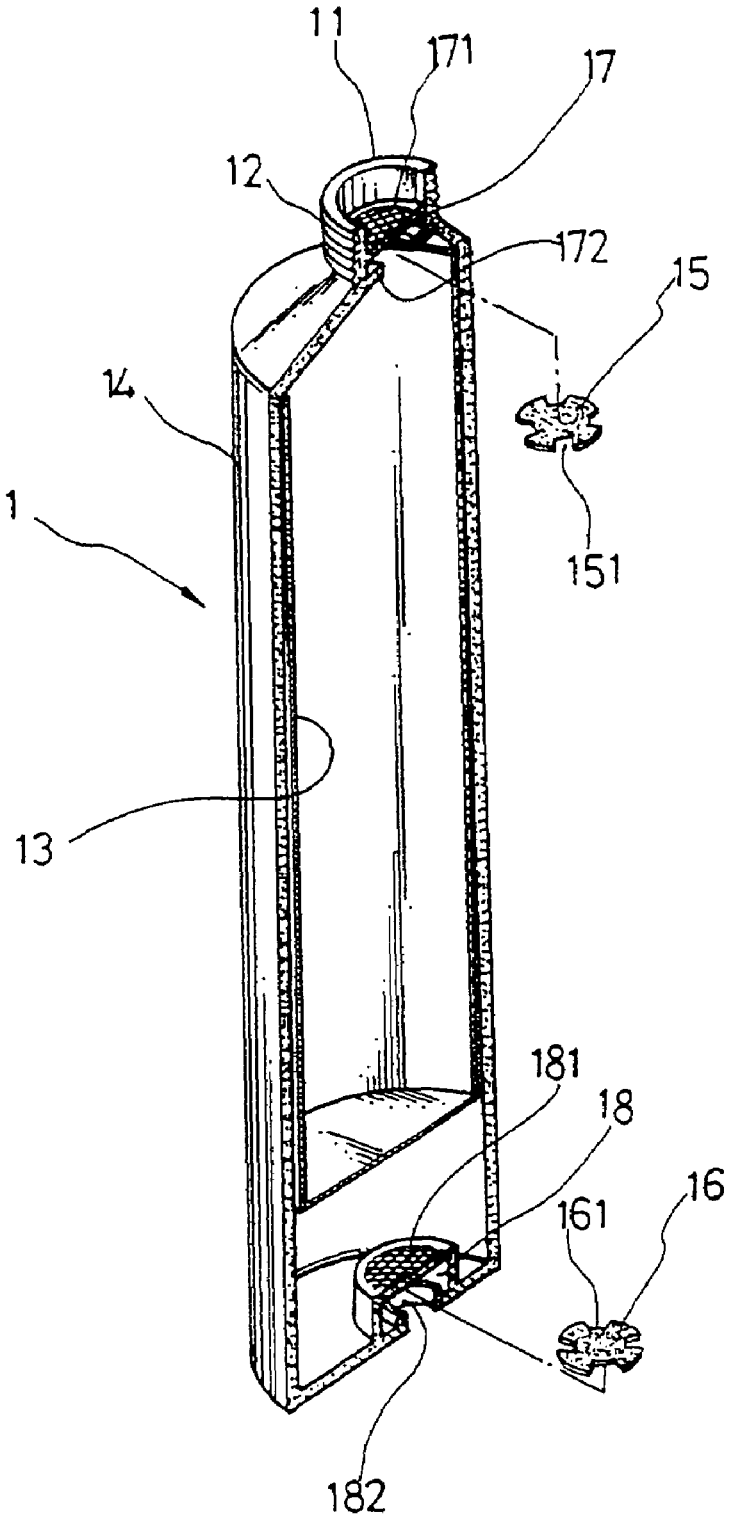
FIG. 3 is an exploded perspective view showing the upper and the lower rubber plate in accordance with the present invention.

Referring to FIG. 3, the enclosure 1 is made of soft PVC material and the enclosure 1 has an inner-layered pocket 13 for enclosing contents, and an outer-layered enclosure 14, which restores to its original shape when it is squeezed. The enclosure 14 is connected to the end opening section of the inner-layered pocket 13 to form as a unit.

Figure 4:
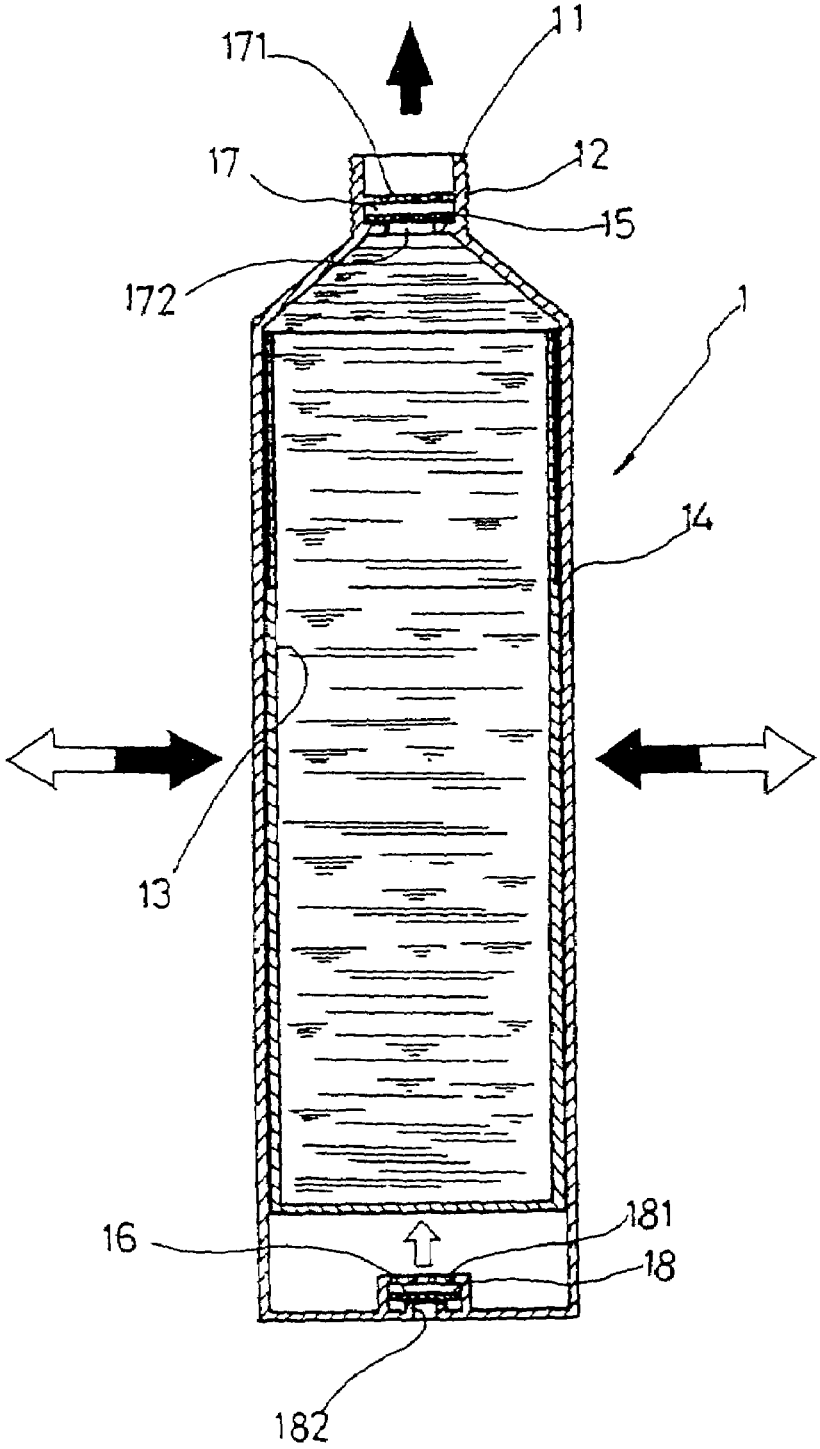
FIG. 4 is a schematic view showing the action of the structure in accordance with the present invention.

Referring to FIG. 4, the squeezed contents is controlled by the alternatively open and close of the upper diaphragm 15 and the lower diaphragm 16. The upper diaphragm 15 is mounted at the inner section of the end opening section 11 of the outer-layered enclosure 14 and is located into a diaphragm slot 17, which is formed integrally. The upper layer of the slot 17 is a netted-hole layer 171 and the lower layer is an outlet layer 172 with holes. As shown in FIG. 3, the upper diaphragm 15 is a rubber plate with an isolation slot 151 and the contents can be delivered via the isolation slot 151 and then via the netted-hole layer 171. The upper diaphragm 15 is corresponding to the outlet layer 172 which is located underneath, and the center region of the diaphragm 15 can be fully sealed.

As shown in FIGS. 3 and 4, the lower diaphragm 16 and the upper diaphragm 15 are rubber diaphragm having an isolation slot 161 and are located at the bottom section of the outer-layered enclosure having the diaphragm slot 18 formed integrally as a unit. The upper layer of the slot 18 is an netted-hole layer 181 and the lower layer is a inlet hole layer 182 with holes, and the upper diaphragm slot 17 has the same structure as the lower diaphragm slot 18.

The upper diaphragm 15 and the lower diaphragm 16 are slightly reciprocated when the contents are depressed or released. When the contents are depressed (or squeezed), the contents push upward and push the upper diaphragm 15 to open and the contents are delivered from the isolation slot 151 via the netted-hole layer 171. When the depress action is removed, the internal suction causes the upper diaphragm 15 to adhere the outlet layer 172 to close the hole, prohibiting air from coming into the enclosure to contact with the contents.

When the upper diaphragm 15 is opening and closing as a result of squeezing action, the lower diaphragm also provides the similar but opposite closing and opening action. When a squeezing action is implanted, the lower diaphragm 16 automatically closes, and the outer-layered enclosure is provided with a proportional internal pressure, and therefore, the lower diaphragm 16 is at a closing state. When the squeezing action is released, the outer-layered enclosure 14 and the delivery of the contents of the enclosure cause a slight suction and lower diaphragm 16 moves upward so that an opening state is formed. Air enters to fill the space of the discharged contents. Thus, the contents will gradually be used up with this process. Thus, the present invention provides a constant quality delivery of contents and isolating external air from entering.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A double-layered fluid container comprising:

an enclosure made of soft material and having an inner-layered pocket and an outer-layered enclosure, said outer-layered enclosure having an end opening section which has an external edge provided with threads, said outer-layered enclosure being connected to an end opening section of said inner-layered pocket to form into a unit, said end opening section being formed with a first diaphragm slot, said outer-layered enclosure having a bottom provided with a second diaphragm slot;

an upper diaphragm fitted in said first diaphragm slot at an end opening section of said outer-layered enclosure, said first diaphragm slot having a first upper layer which is a netted-hole layer and a first lower layer which is an outlet layer with holes, said upper diaphragm being a rubber plate with a plurality of notches, said upper diaphragm being fitted between said first upper and lower layers;

a lower diaphragm fitted in said second diaphragm slot, said second diaphragm slot having a second upper layer which is a netted hole layer and a second lower layer which is an outlet layer with holes, said lower diaphragm being a rubber plate with a plurality of notches, said lower diaphragm being fitted between said second upper and lower layers; and a cap engageable with said threads of said enclosure.

* * * * *